United States Patent [19]

Voss et al.

[11] Patent Number: 4,825,933

[45] Date of Patent: May 2, 1989

[54] COUNTERGRAVITY CASTING APPARATUS

[75] Inventors: Karl D. Voss, Standish; James B. Mercer, Saginaw, both of Mich.

[73] Assignee: General Motors Corporation, Detroit, Mich.

[21] Appl. No.: 211,024

[22] Filed: Jun. 24, 1988

[51] Int. Cl.[4] ..... B22D 18/06

[52] U.S. Cl. ..... 164/255; 164/306; 164/341

[58] Field of Search ..... 164/119, 255, 306, 63, 164/65, 256, 254, 361, 363, 364, 339, 341, 137

[56] References Cited

U.S. PATENT DOCUMENTS

| | | | |
|---|---|---|---|
| 2,379,401 | 6/1945 | Poulter . | |
| 3,774,668 | 11/1973 | Iten et al. | 164/255 |
| 4,340,108 | 7/1982 | Chandley et al. | 164/63 |
| 4,508,157 | 4/1985 | Belliveau et al. | 164/63 |
| 4,632,171 | 12/1986 | Almond | 164/255 |
| 4,658,880 | 4/1987 | Voss | 164/255 |

*Primary Examiner*—Kuang Y. Lin

*Attorney, Agent, or Firm*—Lawrence B. Plant

[57] ABSTRACT

Apparatus for the vacuum countergravity casting of metal in shell molds including a gas-permeable upper shell mold portion secured to a bottom mold portion and together secured to the mouth of a vacuum box by a plurality of threadable mounting sites engaged by self-tapping threads on the ends of rotatable shafts reciprocally slidable through the ceiling of the box. Each shaft has a stop fixed thereto at a predetermined distance above the threads for pressing the upper shell mold portion into sealing engagement with the bottom mold portion in order to eliminate the need to glue the upper and lower mold portions together.

13 Claims, 2 Drawing Sheets

COUNTERGRAVITY CASTING APPARATUS

This invention relates to apparatus for the vacuum, countergravity casting of metal in gas-permeable, shell molds immersed in a pot of molten metal and, more particularly, to mounting the mold to the vacuum chamber so as to eliminate the need to adhesively bond the mold portions (i.e., cope, drag, cheeks, etc.) together.

BACKGROUND OF THE INVENTION

The vacuum, countergravity, shell mold casting process is particularly useful in the making of thin-walled, near-net-shape castings and involves: sealing a bottom-gated mold, having a gas-permeable upper portion, to the mouth of a vacuum chamber such that the chamber confronts the upper portion; immersing the underside of the mold in an underlying melt; and evacuating the chamber to draw melt up into the mold through one or more of the gates in the underside thereof. Such a process is shown in U.S. Pat. No. 4,340,108 wherein the mold comprises a resin-bonded-sand shell having an upper cope portion and a lower drag portion sealingly held to the mouth of the vacuum chamber by means of spring clips. U.S. Pat. No. 4,340,108 seals the mold to the vacuum chamber atop the cope such that the parting line between the mold halves lies outside the vacuum chamber. U.S. Pat. No. 4,632,171 seals the mold to the mouth of the vacuum chamber atop the drag such that the parting line between the cope and drag falls within the vacuum chamber. U.S. Pat. No. 4,658,880 secures the mold to the vacuum chamber by means of a plurality of reciprocable and rotatable shafts having self-tapping threads on the lower ends thereof engaging mounting sites atop the mold. Reversible motors rotate the shafts so as to screw the threads into engagement/disengagement with the mounting sites to mount/demount the mold to/from the vacuum chamber. Screwing of the threads into the mounting sites draws the mold into sealing engagement with the mouth of the vacuum chamber. Chandley, G. D. *Automatic Countergravity Casting of Shell Molds,* Modern Casting, October 1983, pages 29–31, describes a technique for mounting round molds to a round vacuum chamber wherein the inside surface of the vacuum chamber includes self-tapping threads which screw into the periphery of the round mold. The aforesaid prior art all disclose molds wherein the upper and lower halves are glued together. The gluing process is expensive and time consuming and elimination thereof would improve the efficiency and economics of the process.

It is an object of the present invention to provide improved apparatus for the vacuum, countergravity casting of shell molds including means for mounting the mold to the mouth of the vacuum box while concurrently securing the upper and lower mold portions together without glue. It is a further object of the present invention to provide such improved apparatus with means for automatically controlling the securing of the mold members together while mounting the mold to the vacuum chamber. These and other objects and advantages of the present invention will become more readily apparent from the detailed description thereof which follows.

BRIEF DESCRIPTION OF THE INVENTION

The present invention is an improvement on the mold mounting/demounting technique in U.S. Pat. No. 4,658,880, which is intended to be incorporated herein by reference, and further includes stop means immovably secured to the mounting shafts to press the upper (i.e., cope) mold portion into sealing engagement with the lower (i.e., drag) mold portion and thereby eliminate the need to glue the mold halves together before hand. As in U.S. Pat. No. 4,658,880, the improved apparatus includes: a mold having a porous, gas-permeable upper shell and a bottom-gated lower portion secured to the upper shell; a vacuum box defining a chamber confronting the upper shell for evacuating the mold through the shell, which box comprises a continuous wall having a peripheral edge on the underside thereof for sealingly engaging the mold and a ceiling overlying the mold; a plurality of threadable mounting sites on the mold; retainer means reciprocably slidable through the ceiling of the box and comprising a plurality of shafts extending sealingly through the ceiling of the chamber and having self-tapping threads on the lower end of each shaft engaging a mounting site on the mold; and motor means for rotating each shaft so as to screw the threads into engagement/disengagement with the mounting site as is appropriate for mounting and demounting the mold to the vacuum chamber. In accordance with Applicants' improvement, a substantially immovable stop (e.g., shoulder, washer, etc.) is located along the shaft a preset distance up from the drag-engaging threaded end thereof. By "substantially immovable" is meant locked or otherwise secured at a fixed location on the shaft so as not to permit significant relative movement thereof along the shaft during mounting of the mold to the chamber. The mold-engaging threads on the end of each of the shafts pass through an opening in the upper cope portion and embed themselves in the mounting sites on the lower drag portion. The distance between the stop and the threaded end of the shaft will depend upon the thickness of the upper cope portion at the openings therein through which the shafts pass and the depth to which the self-tapping threads penetrate into the drag and is such that when the self-tapping threads screw into the drag the stop is caused to seat atop the cope and press it into sealing engagement with the drag. Preferably, means are provided for readily changing or adjusting the location of the stop along the shaft so that the same chamber can be used with a variety of molds of different thicknesses. Such adjustability results in a minimum of machine downtime to changeover from one mold to the next. Adjustability may be provided by threads on the shaft and a cooperating threaded washer-like stop or by providing a socket in the end of a shoulder-bearing shaft adapted to receive mold-engaging, threaded inserts.

As the mold materials (e.g., resin-bonded sand, ceramic, etc.) are often quite frangible, it is preferred to provide the apparatus with means for stopping the rotation of the shafts after the stop has sufficiently seated on the cope to hold it sealingly to the drag but before the shaft threads strip out the threads formed in the mold at the anchoring sites. For example, a limit switch may be used to detect the relative movement of the stop, or, preferably, pressure sensors, strain gages, or the like, responsive to the pressing of the stop against the cope are used to sense when the stop firmly seats on the cope and stop rotation of the shaft.

DETAILED DESCRIPTION OF SPECIFIC EMBODIMENTS

The invention may better be understood when considered in the light of the following detailed description of certain specific embodiments thereof which is given hereafter in conjunction with the several drawings in which.

Figure 1:
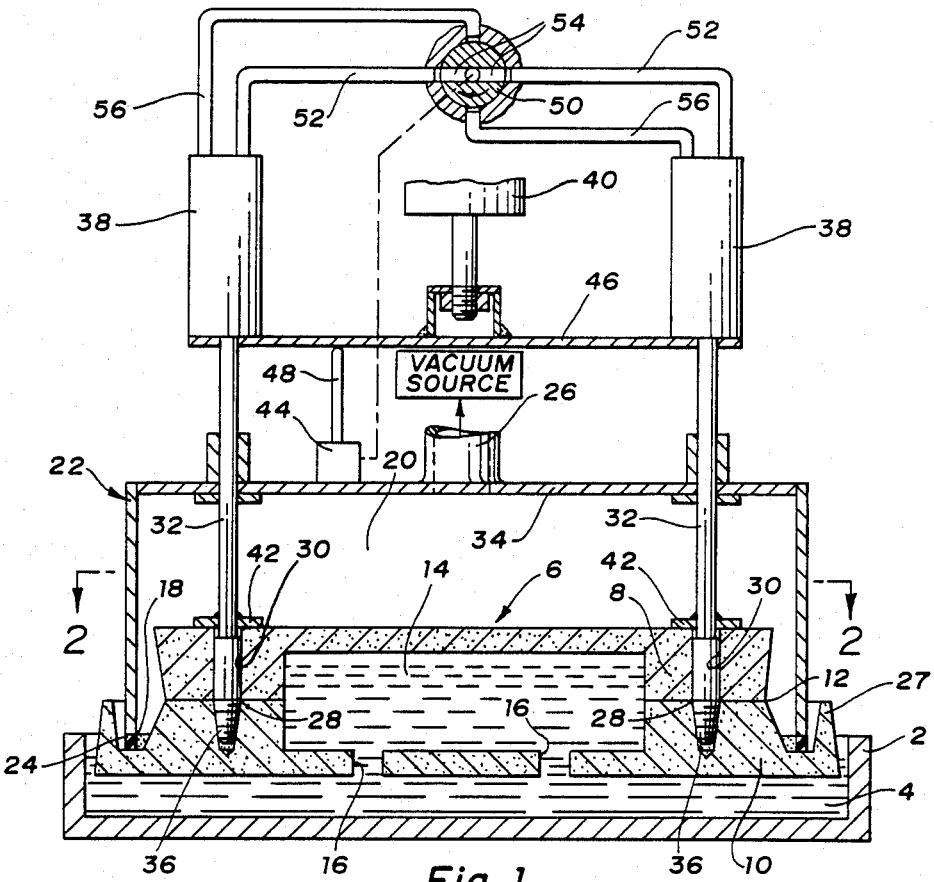
FIG. 1 is a partially sectioned elevational view of a countergravity casting apparatus according to the present invention.
Figure 2:
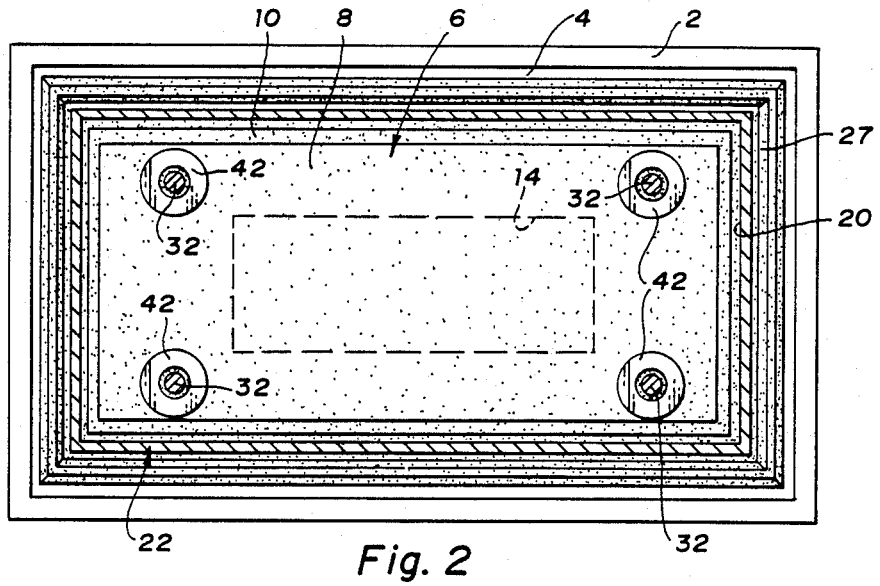
FIG. 2 is a sectioned view in the direction 2—2 of FIG. 1.

FIG. 1 depicts a pot 2 of metal melt 4 which is to be drawn up into a mold 6 comprising a gas-permeable upper shell portion 8 and a lower portion 10 joined at a parting line 12 and defining a molding cavity 14 therebetween. The lower portion 10 includes a plurality of ingates 16 on the underside thereof for admitting melt to the mold cavity 14 when it is evacuated through the shell 8. The lower portion 10 of the mold 6 is sealed to the mouth 18 of a vacuum chamber 20 (i.e., defined by vacuum box 22) via a compressible seal 24 (e.g., high temperature rubber, ceramic rope, etc.) along the lower peripheral edge of the box 22 such that the upper portion 8 is encompassed by the chamber 20. The vacuum chamber 20 is communicated to a vacuum source (not shown) via conduit 26. The upper portion 8 of the mold 6 comprises a gas-permeable material (e.g., resin-bonded sand) which permits gases to be withdrawn from the casting cavity 14 when a vacuum is drawn in the chamber 20. The lower portion 10 of the mold 6 may conveniently comprise the same material as the upper portion 8 or other materials, permeable or impermeable, which are compatible with the upper portion material. The lower portion 10 includes an upstanding levee 27 surrounding the seal 24 and isolating it from the melt 4 as described in copending U.S. patent application Ser. No. 077,891, filed July 27, 1987 and assigned to the assignee of the present invention.

The lower portion 10 includes a plurality of anchoring sites 28 registered with openings 30 in the upper portion 8. A plurality of rotatable shafts 32 slidably extend through the ceiling 34 of the box 22 and include self-tapping threads 36 on the lower ends thereof adapted to screw into the mounting sites 28 in the lower portion 10. Reversible air motors 38 serve to rotate the shafts 32 in a first direction to screw the threads 36 into the anchoring sites 28 of lower portion 10 when mounting the mold to the vacuum box 22 and, after casting, to rotate the shafts 32 in the opposite direction to unscrew and release the mold 6 from the vacuum box 22. An air cylinder (partially shown) 40 serves to move the threads 36 into initial engagement with the anchoring sites 28 when mounting the mold to the vacuum box 22 and subsequently retracting the threaded ends 36 from the mold 6 after the casting has cooled sufficiently to release the mold 6 from the box 22. During the mold mounting phase the final downward movement of the shafts 32 occurs as a result of the action of the threads 36 boring into the anchoring sites 28. Washer-like stops 42 are welded to the shafts 32 so that they will seat atop the upper portion 8 around the openings 30 when the threads 36 are fully seated in the anchoring sites 28. The stops 42 press the upper portion 8 firmly enough against the lower portion 10 to effect a seal therebetween sufficient to prevent molten metal from escaping the cavity 14 via the parting line between the upper and lower portions 8 and 10, respectively.

In order to prevent the threads 36 from stripping out the threads formed at the anchoring sites 28 when the stop 42 seats against the upper portion 8, an arm 48 on a limit switch 44 atop the vacuum box 22 is engaged by the platform 46 carrying the shaft motors 38. In this regard, when the platform 46 engages the arm 48 the switch 44 energizes a motor controlled valve 50 which rotates to cut off the air to the forward direction inlet lines 52 of the air motors 38 and rotation thereof ceases.

In operation the mold 6 rests firmly on a support such as a conveyor, or the like. The box 22 is then lowered into engagement with the mold 6. Thereafter the cylinder 40 lowers the platform 46 until the threaded ends 36 engage the anchoring sites 28 and begin to screw into the sites. Further downward movement of the platform is controlled solely by the action of the threads as they tap their way into sites 28. When the platform 46 engages the arm 48 of the switch 44, rotation of the motors 38 stops. The switch 44 is set to stop rotation of the motors 38 when the stop 42 seats on the upper portion 8 sufficiently to seal it to the bottom portion 10 and before continued rotation would strip out the threads formed in the lower portion 10. A vacuum is then drawn in the vacuum chamber 20 and melt 4 sucked into the mold cavity 14 via the ingates 16. The mold 6 is then removed from the pot 2 at a location remote from the pot 2 released from the vacuum box 22. In this regard, the motor controlled valve 50 is rotated so as to align its outlets 54 with the reverse direction inlet lines 56 of the motors 38 and thereby unscrew the screws 36 from the mounting sites 28 and drop the mold 6 from the vacuum box 22 as the air cylinder 40 retracts the shafts 32 up into the box 22.

Figure 3:
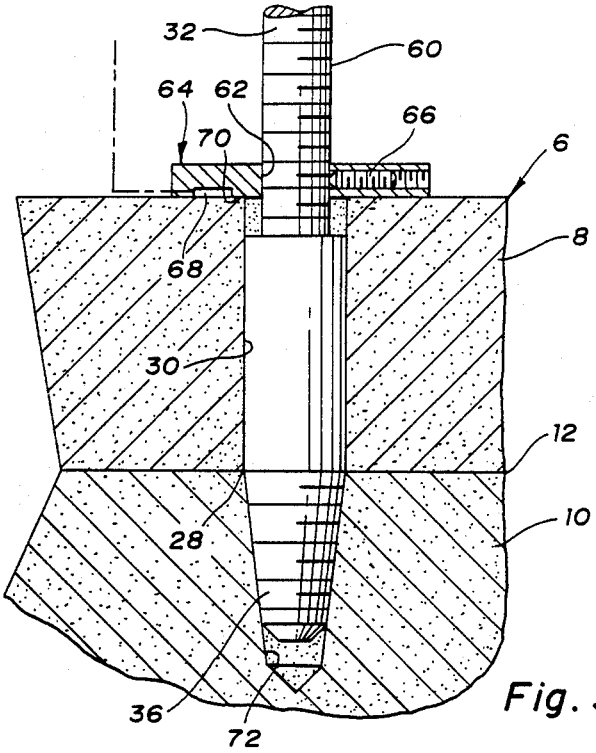
FIG. 3 is a sectioned elevational view of a different mold retainer embodiment of the present invention.

FIG. 3 shows another embodiment of the present invention wherein the shaft 32 is provided with fine external threads 60 which cooperate with internal threads 62 on the washer-like stop 64. The cooperating threads provide ready axial adjustment of the stop 64 along the shaft 32. A set screw 66 locks the stop 64 to the shaft 32 when the appropriate location along the shaft 32 is obtained. A pressure sensor 68 (e.g., piezoelectric) is provided in the underface 70 of the adjustable stop 64 to sense when the stop 64 firmly engages the upper portion 8 and signals cessation of the rotation of the motors 38. As shown in this Figure, the anchoring site 28 may be predrilled 72 to receive the threads 36 though predrilling is not necessary to the practice of the invention.

Figure 4:
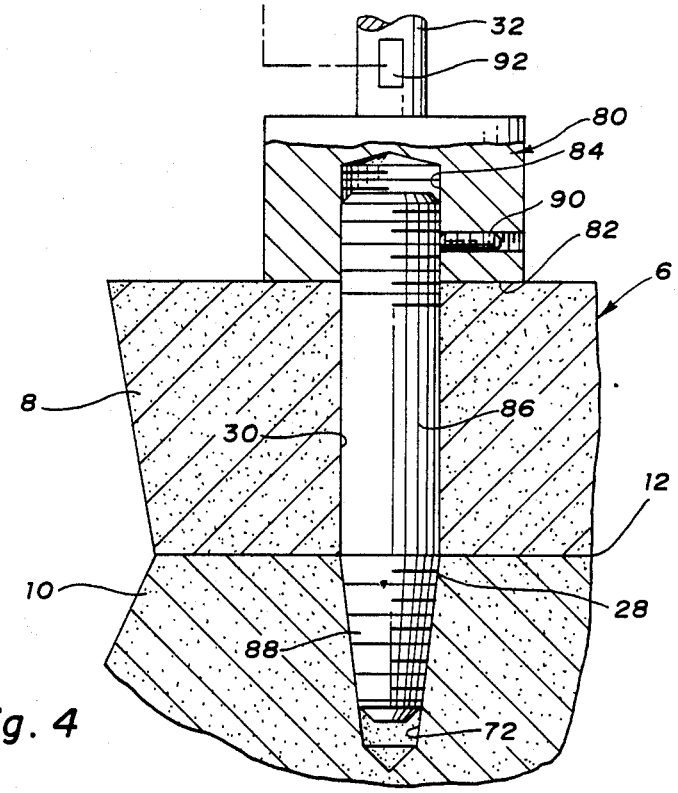
FIG. 4 is a sectioned elevational view like that of FIG. 3 but of still another mold-retainer embodiment of the present invention.

FIG. 4 depicts still another embodiment of the present invention wherein the shaft 32 includes a stop 80 which seats on the upper portion 8 at the shoulder 82. The stop 80 has a threaded bore 84 therein adapted to receive a separate insert tip 86. The insert 86 includes self-tapping threads 88, as discussed above and its length (i.e., relative to the shoulder 82) can readily be adjusted by screwing it more or less into the threaded bore 84 and locking it in place by means of the set screw 90. A broader range of adjustment can be obtained by using longer or shorter inserts 86 as may be required to accommodate a variety of different molds. A strain gage, or the like, 92 is provided on the shaft 32 to sense any strain experienced by the shaft when the stop 80 seats on the upper portion 8. The signal from the strain gage 92 triggers cessation of the rotation of the motors 38 driving the shaft 32 as discussed above.

While the invention has been disclosed primarily in terms of specific embodiments thereof it is not intended to be limited thereto but rather only to the extent set forth hereafter in the claims which follows.

The embodiments of the invention in which an exclusive property or privilege is claimed are defined as follows:

1. Apparatus for the vacuum, countergravity casting of molten metal comprising:

a mold comprising a porous, gas-permeable upper shell at least in part defining a molding cavity, and a lower portion adapted for immersion into a pot of said molten metal underlying said mold, said lower portion including at least one gate in the underside thereof for admitting said metal into said cavity upon evacuation of said cavity;

a plurality of threadable mounting sites on said lower portion;

vacuum box defining a vacuum chamber confronting said upper shell for evacuating said cavity through said shell, said box having a ceiling overlying said mold and a peripheral edge on the underside thereof defining a mouth receiving and sealingly engaging said lower portion;

means for engaging said sites so as to anchor said mold in said chamber, said means comprising a plurality of shafts reciprocally slidable through said ceiling, self-tapping threads on the lower end of each of said shafts for engaging a said site registered therewith;

motor means operatively associated with each said shaft for screwing said threads into engagement-/disengagement with said site to respectively mount/demount said mold to/from said box; and stop means substantially immovably secured to said shaft for engaging and pressing said upper shell into sealing engagement with said lower portion when said threads shall have engaged said site so as to mount said mold in sealing relation to said box.

2. Apparatus according to claim 1 including means responsive to said pressing to terminate said screwing.

3. Apparatus according to claim 1 including means for adjusting the location of said stop means along said shaft relative to said lower end.

4. Apparatus according to claim 1 wherein said stop means comprises a shoulder on said shaft.

5. Apparatus according to claim 1 wherein said upper shell portion includes a plurality of apertures overlying said sites for admitting said shafts to said sites.

6. Apparatus according to claim 3 wherein said adjusting means comprises cooperating threads on said shaft and said stop means.

7. Apparatus according to claim 3 including means for locking said stop means at a selected location along said shaft.

8. Apparatus according to claim 1 wherein said sites comprise sockets preformed in said lower portions.

9. Apparatus according to claim 2 wherein said terminating means includes a pressure sensor operatively associated with said stop means.

10. Apparatus according to claim 1 including means responsive to the axial displacement of said shaft.

11. Apparatus according to claim 3 wherein said adjusting means comprises a socket in the end of said shaft adapted to receive insert means bearing said self-tapping threads.

12. Apparatus according to claim 11 wherein said insert means comprises a set of inserts having different lengths to effect said adjusting means.

13. Apparatus according to claim 11 wherein said insert is axially adjustable within said socket.

* * * * *